US005290044A

United States Patent [19]

Easton et al.

[11] Patent Number: 5,290,044

[45] Date of Patent: Mar. 1, 1994

[54] STIFFENED ARROW NOCK

[75] Inventors: James L. Easton; Don S. Rabska, both of Los Angeles, Calif.

[73] Assignee: Easton Aluminum, Inc., Van Nuys, Calif.

[21] Appl. No.: 21,309

[22] Filed: Feb. 23, 1993

[51] Int. Cl.[5] ..... F42B 6/06

[52] U.S. Cl. ..... 273/416

[58] Field of Search ..... 273/416, 421, 419, 422, 273/420, 423

[56] References Cited

U.S. PATENT DOCUMENTS

| | | | |
|---|---|---|---|
| 2,747,876 | 5/1956 | Teller | 273/420 |
| 4,645,211 | 2/1987 | Beiter | 273/416 |
| 4,706,965 | 11/1987 | Schaar | 273/416 |
| 4,874,180 | 10/1989 | Fingerson et al. | 273/416 |
| 5,067,731 | 11/1991 | Bickel | 273/416 |
| 5,154,432 | 10/1992 | Saunders | 273/416 |

OTHER PUBLICATIONS

*Archery*, Mar. 1974 p. 1 Easton Aluminum Ad.

*Bow & Arrow*, Oct. 1983 p. 12 Graphlex Ad.

*Primary Examiner*—Paul E. Shapiro

*Attorney, Agent, or Firm*—Roth & Goldman

[57] ABSTRACT

A plastic archery arrow nock (10) having a stiffener of light weight high strength material such as carbon composite therein permits fine tuning alteration of the dynamic spine of the arrow and reduces flexure of the nock relative to the arrow shaft (12) to prevent fatigue failure of the nock. The stiffened nock reduces the flex in the nock and the connection of the nock to the arrow shaft arrow shaft (12) as it is propelled forward by acceleration of the bowstring at the moment of release.

9 Claims, 1 Drawing Sheet

STIFFENED ARROW NOCK

BACKGROUND OF THE INVENTION AND PRIOR ART

1. Field of the Invention

This invention relates in general to archery arrows and, more particularly, to arrow nocks affixed to the arrows which receive the bowstring.

2. Prior Art

Conventional arrow nocks are ordinarily made of lightweight metal or plastic and are subject to breakage due to the substantial stresses which are imparted by the bowstring to the nock which in turn transmits such stresses to the arrow during shooting. It has been found that these stresses result in substantial flexing of the connection between the nock and the arrow. This flexing of the nock connection and inconsistent flexing of the nock itself substantially detract from shooting accuracy. The problem is compounded by either intended or unintended off center loading of arrow nocks by highly skilled target archers and the fact that the nock material is usually constructed of plastic which is substantially weaker than the material of which the arrow is constructed. Accordingly, the nock rather than the arrow is subject to fatigue failure and repeated shooting results in increased flexing of the connection until failure occurs at which time the nock is simply replaced.

High level target archery requires precise fine tuning of the arrows to the bow to obtain consistent results. The objective here is to substantially achieve one complete cycle of arrow flexing as the arrow leaves the bow so that the two bending nodes of the arrow remain aligned with the target and so that the fletch does not contact the bow and thus disrupt the intended line of flight of the arrow. With a finger controlled bowstring release, the arrow first flexes toward the bow then away from it. This flex is increased whenever the weight of the point is increased since the bowstring must induce motion of a greater mass. Accordingly, if a complete cycle of flex is desired by the time the arrow leaves the bow so that contact of the fletch with the bow is negligible or non-existant, a means for adjusting the flex of the arrow is needed.

Among the parameters which have in the past been varied to change the dynamic stiffness or flex without changing the length of the arrow are the point weight and the shaft stiffness. In the prior art, the archer could only change shafts or adjust the arrow by changing the point weight since most prior art replaceable nocks are of substantially identical characteristics so that a nock change made no substantial difference. If the archer wished to match the arrow stiffness with a particular bow, in the past he had no easy way to do so.

Although it is well known that arrows flex when propelled by the bowstring and continue to do so while in flight, it is not readily appreciated that the amount of flex can be controlled by adding weight to the nock. Flex in the connection between the arrow and the nock also occurs and this connection should therefore also be stiffened to compensate for the added weight. Arrow flex is ordinarily reduced by stiffening of the arrow shaft itself where the flex is known to take place. This necessarily results in significant additional arrow weight and correspondingly less arrow velocity. Consideration has been given to stiffening of the nock material with fiber reinforcement; however, this has been found to lower the overall impact resistance of the nock and eliminate desired visual transparency of the plastic which is important in determining if nock failure has taken place.

It is an objective of the present invention to provide a means of adjusting the flex or dynamic spine of the arrow to tune the arrow to the bow.

It is a further objective of the present invention to provide a means of adjusting the dynamic spine or flex without substantially changing of the location of the center of gravity of the arrow.

It is a further objective of the present invention to provide an easily replaceable arrow nock which prevents damage from incoming arrows to the shaft of an arrow shaft embedded in a target.

SUMMARY OF THE INVENTION

The present invention accordingly provides a stiffened arrow nock comprising: a nock body having a central axis which is to be aligned with the centerline of an arrow shaft, an arrow shaft connecting end which is substantially centered on said axis, a bowstring receiving groove opening away from said arrow shaft connecting end, said nock body having an elongated cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener.

The present invention further provides an archery arrow comprising a shaft having a central axis and a stiffened arrow nock affixed thereto, said nock comprising: a nock body having a central axis which is to be aligned with the centerline of an arrow shaft, an arrow shaft connecting end which is substantially centered on said axis, a bowstring receiving groove opening away from said arrow shaft connecting end, said nock body having an elongated cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener.

DESCRIPTION OF THE PREFERRED EMBODIMENTS

Figure 1:
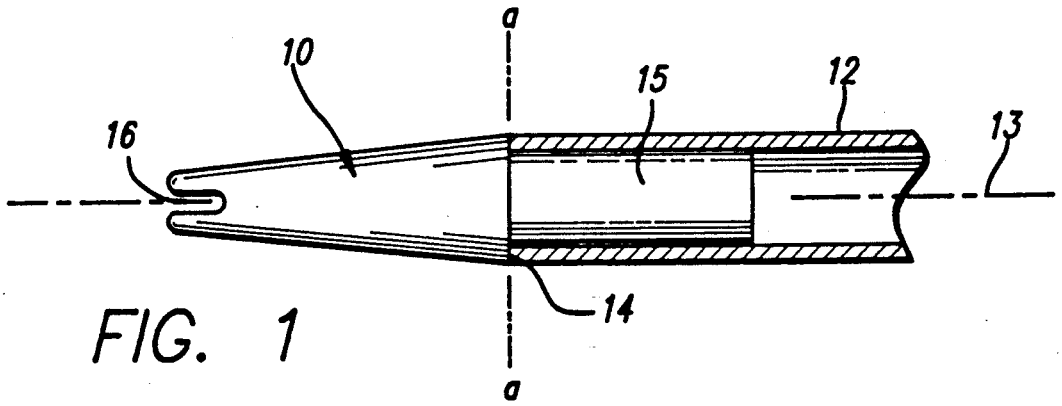
FIG. 1 is a plan view, partly in section, of a prior art arrow and nock affixed thereto.

FIG. 1 shows an ordinary prior art arrow nock 10, typically made of plastics that exhibit outstanding compromise between stiffness and impact resistance such as polycarbonates, butyrates or nylon, affixed to an arrow shaft 12 having a central axis 13. Nock 10 has an annular flat arrow receiving shoulder 14 and an integrally formed longitudinally extending hollow plug 15 which is tightly inserted into the arrow and to which the arrow is cemented or otherwise attached. A bowstring receiving groove shown at 16 is ordinarily centered on axis 13 of the arrow shaft 12 and nock 10. Since stresses imparted to the nock and arrow during shooting cause substantial flexing of the nock 10 relative to the arrow and subsequent failure of the nock plug 15 generally at the line a—a where the arrow abuts the nock, the nock 10 is shown slightly misaligned from the arrow shaft 12 as occurs particularly after the nock has weakened through repeated use and flexes to an increasingly greater extent. The amount of misalignment is exaggerated for clarity of illustration but is known to increase with repeated use of the arrow until nock failure occurs. The greater the amount of flexing of the nock 10 relative to the arrow shaft 12, the more unpredictable is the reaction of the arrow (at the moment of release), resulting in loss of accuracy.

Figure 2:
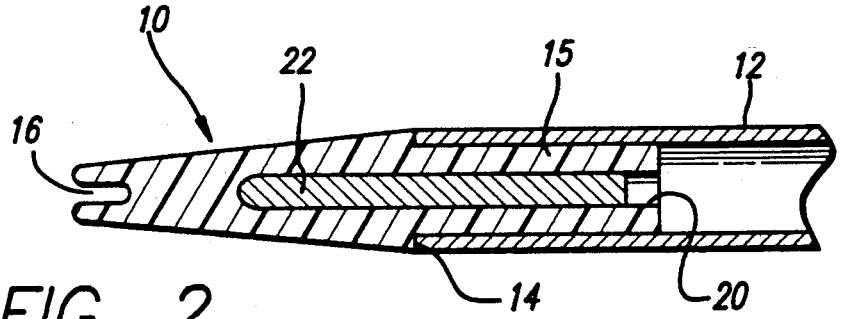
FIG. 2 is a plan view like FIG. 1 but showing a first embodiment of a stiffened arrow nock affixed to an arrow.
Figure 3:
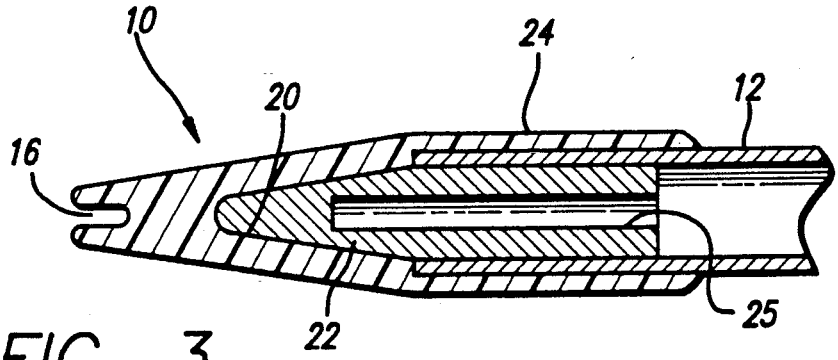
FIG. 3 is a plan view of a second embodiment of a stiffened arrow nock slid over the end of an arrow.
Figure 4:
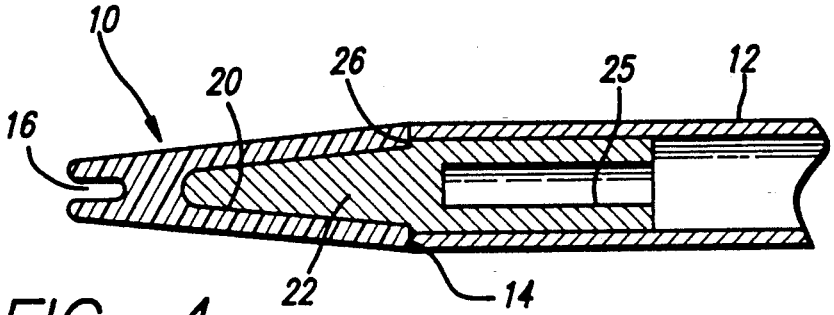
FIG. 4 is a plan view of a third embodiment of a stiffened arrow nock having a flush abutment fit with an arrow.

FIGS. 2, 3 and 4 show three different embodiments of the invention which overcome the problems associated with prior art nocks. In FIG. 2, the nock 10 is essentially of the same configuration as that shown in FIG. 1 but has been provided with a centrally aligned elongated somewhat bullet shaped stiffener receiving cavity 20 into which is placed an elongated solid or hollow stiffener 22 of lightweight high strength material, preferably carbon composite or a metal such as aluminum. The nock 10 seen in FIG. 2 has an outside diameter which is the same or nearly the same as the outside diameter of the arrow shaft and has an integrally formed longitudinally extending hollow plug 15 extending outwardly from shoulder 14, the plug 15 being closely received inside of the arrow shaft 12 such that the nock 10 may be affixed to the shaft 12 by cement or press fit therein.

The FIG. 3 embodiment shows a nock 10 designed to slip over the outside of the end of the arrow shaft. Elongated cavity 20 in the nock 10 is of the same inside diameter as that of the arrow shaft 12 and receives an elongated stiffener 12 similar to the one above described with reference to FIG. 2. In this embodiment, the stiffener 22 extends into and directly contacts the arrow shaft 12 and the nock plug 15 is not present. Instead, nock 10 has an integrally formed sleeve 24 extending from shoulder 14 over the outside of the arrow shaft 12 whereby the nock 10 may be cemented or press fit onto the shaft 12. In the embodiment of FIG. 3, the stiffener 22 has a hollow weight reduction cavity 25 therein. The use of the stiffener 22 adds a small amount of mass to nocck end of the arrow to permit fine tuning of its dynamic spine. Since the stiffener is also substantially stronger than the nock material, the stiffener absorbs and resists most of the nock flexure which would occur in absence of the stiffener.

In FIG. 4, a modified nock embodiment is shown in which the nock 10 has an abutment shoulder 14 having an outer diameter which is the same as the outer diameter of the arrow shaft 12 at the connecting end whereby the nock and arrow shaft present a flush abutment fit. The stiffener 22 also has a weight reduction cavity 25 and an abutment shoulder 26 which aligns with the end of the arrow shaft 12 and abuts with the shoulder 14 on the nock 10 which is somewhat thicker at its arrow abutment end than the thickness of the wall of the arrow shaft 12.

Persons skilled in the art will readily appreciate that various modifications can be made from the preferred embodiment thus the scope of protection is intended to be defined only by the limitations of the appended claims in which reference numerals have been included merely for explanation rather than limitation.

We claim:

1. A stiffened arrow nock comprising: a nock body having a central axis which is to be aligned with the centerline of an arrow shaft, an arrow shaft connecting end which is substantially centered on said axis, a bowstring receiving groove opening away from said arrow shaft connecting end, said nock body having an elongated generally cylindrical cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener, said nock body having a shoulder which abuts the end of said arrow shaft, said nock including an elongated member adapted to receive the end of said arrow shaft and wherein said elongated member is a plug having a cylindrical exterior surface, said cavity extending through said plug, said shoulder and said exterior cylindrical surface of said plug comprising the sole areas of contact of said nock with said arrow shaft.

2. The stiffened arrow nock of claim 1, wherein said nock body is transparent plastic.

3. The stiffened arrow nock of claim 1, wherein said stiffener is graphite composite.

4. A stiffened arrow nock comprising: a nock body having a central axis which is to be aligned with the centerline of an arrow shaft, an arrow shaft connecting end which is substantially centered on said axis, a bowstring receiving groove opening away from said arrow shaft connecting end, said nock body having an elongated generally cylindrical cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener, said nock body having a shoulder which abuts the end of said arrow shaft, said nock including an elongated member adapted to receive the end of said arrow shaft, wherein said elongated member comprises a sleeve (FIG. 3) having an interior cylindrical surface, said sleeve extending from said shoulder and being adapted to receive said arrow shaft, said stiffener having an exterior cylindrical surface which extends away from said cavity and is spaced from said interior cylindrical surface of said sleeve to confine the end of the arrow shaft therebetween.

5. The stiffened arrow nock of claim 4, wherein said stiffener has a weight reducing cavity therein.

6. A stiffened arrow nock comprising: a nock body having a central axis which is to be aligned with the centerline of an arrow shaft, an arrow shaft connecting end which is substantially centered on said axis, a bowstring receiving groove opening away from said arrow shaft connecting end, said nock body having an elongated generally cylindrical cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener, said nock body having a shoulder which abuts the end of said arrow shaft, and said stiffener having an abutment shoulder which abuts said abutment shoulder on said nock (FIG. 4).

7. The stiffened arrow nock of claim 6, wherein said stiffener has a weight reducing cavity therein.

8. An archery arrow comprising a shaft having a central axis and a stiffened arrow nock affixed thereto, said nock comprising: a nock body having a central axis aligned with the centerline of an arrow shaft, an arrow shaft connecting end which is substantially centered on said axis, a bowstring receiving groove opening away from said arrow shaft connecting end, said nock body having an elongated cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener, said nock body having a shoulder which abuts the end of said arrow shaft and said nock includes an elongate plug (FIG. 2) having a cylindrical exterior surface which extends into and contacts the interior wall of the arrow shaft, said cavity extending through said plug, said shoulder and said exterior cylindrical surface of said plug comprising the sole areas of contact with said arrow shaft.

9. An archery arrow comprising a shaft having a central axis and a stiffened arrow nock affixed thereto, said nock comprising: a nock body having a central axis aligned with the centerline of an arrow shaft, an arrow shaft connecting end which is substantially centered on said axis, a bowstring receiving groove opening away from said arrow shaft connecting end, said nock body having an elongated cavity therein aligned on said axis; and an elongated stiffener of stronger material than the material of said nock body, said stiffener being tightly received in said elongated cavity and having a portion which is adapted to extend into said arrow shaft to stiffen the connection to the arrow and the region of said nock body which surrounds said stiffener, wherein said nock body has a shoulder which abuts the end of said arrow shaft and said nock includes an elongate sleeve having an interior cylindrical surface (FIG. 3), said sleeve extending from said shoulder and receiving the end of said arrow shaft, said stiffener having an exterior cylindrical surface which is spaced from said interior cylindrical surface of said sleeve confining the end of said arrow shaft therebetween.

* * * * *